US009278546B2

(12) United States Patent
Nobayashi

(10) Patent No.: US 9,278,546 B2
(45) Date of Patent: Mar. 8, 2016

(54) OPTICAL WRITING HEAD AND IMAGE FORMING APPARATUS

(75) Inventor: Kazuya Nobayashi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/404,430

(22) Filed: Feb. 24, 2012

(65) Prior Publication Data

US 2012/0224018 A1 Sep. 6, 2012

(30) Foreign Application Priority Data

Mar. 4, 2011 (JP) ..... 2011-047245

(51) Int. Cl.
*B41J 2/47* (2006.01)
*B41J 2/45* (2006.01)

(52) U.S. Cl.
CPC ..... *B41J 2/451* (2013.01)

(58) Field of Classification Search
USPC ..... 347/238, 239, 255, 224, 225, 241, 256; 359/204.1–204.5
See application file for complete search history.

(56) References Cited

U.S. PATENT DOCUMENTS

| | | | | | |
|---|---|---|---|---|---|
| 5,586,096 | A * | 12/1996 | Isobe et al. | 369/102 |
| 5,689,491 | A * | 11/1997 | Isobe et al. | 369/112.05 |
| 6,303,276 | B1 * | 10/2001 | Savant et al. | 430/321 |
| 6,480,219 | B1 * | 11/2002 | Uejima et al. | 347/241 |
| 6,560,018 | B1 * | 5/2003 | Swanson | 359/569 |
| 6,809,829 | B1 * | 10/2004 | Takata et al. | 356/520 |
| 7,486,306 | B2 | 2/2009 | Tsujino et al. | |
| 7,587,118 | B2 | 9/2009 | Nobayashi et al. | |
| 7,733,363 | B2 * | 6/2010 | Sowa et al. | 347/238 |
| 2009/0257039 | A1 * | 10/2009 | Kishikawa et al. | 355/70 |
| 2011/0199662 | A1 | 8/2011 | Yasuda et al. | |

FOREIGN PATENT DOCUMENTS

| | | | | |
|---|---|---|---|---|
| GB | 2314943 | A * | 1/1998 | G03B 21/62 |
| JP | 2000-233529 | A | 8/2000 | |
| JP | 2006234955 | A * | 9/2006 | G02B 26/10 |
| JP | 2011-170036 | A | 9/2011 | |
| WO | WO 0114790 | A1 * | 3/2001 | F21V 5/02 |

* cited by examiner

*Primary Examiner* — Hai C Pham
(74) *Attorney, Agent, or Firm* — Fitzpatrick, Cella, Harper & Scinto

(57) ABSTRACT

An optical writing head includes a light emitting device array having a plurality of light emitting device that emit parallel rays of light, and an optical unit arranged between the light emitting device array and an image plane to form an image by the rays of light emitted from the light emitting devices on the image plane. The optical unit includes a two-dimensional grating.

24 Claims, 7 Drawing Sheets

OPTICAL WRITING HEAD AND IMAGE FORMING APPARATUS

CLAIM OF PRIORITY

This application claims the benefit of Japanese Patent Application No. 2011-047245, filed Mar. 4, 2011, which is hereby incorporated by reference herein in its entirety.

BACKGROUND OF THE INVENTION

1. Field of the Invention

The present invention relates to an optical writing head and an image forming apparatus. More particularly, the present invention relates to an optical writing head designed to cause a plurality of light emitting devices to project rays of light onto a target irradiation surface by means of a lens array to form image formation spots, and an image forming apparatus using the same. Such an optical writing head finds applications in the fields of electrophotographic copying machines, printers, and facsimile machines.

2. Description of the Related Art

Known optical writing heads to be used in electrophotographic copying machines include an array of light emitting devices, such as LEDs, and a rod lens array formed by arranging a plurality of rod lenses having a refractive index distribution between the light emitting device array and a photosensitive drum that operates as an image carrier.

A flux of light that is modulated according to an image signal is emitted from each of the light emitting devices and converged to a spot on the surface of the photosensitive drum by the rod lens array to record an image.

Such optical writing heads are required to have a structure that can be more easily assembled.

When the rod lens array and the light emitting device array are displaced relative to each other so as to show a shift from a preset value, the shape of the entrance pupil and that of the exit pupil change to thereby change the quantity of light and the shape of a light spot formed on the surface of the photosensitive drum.

Then, as a result, an uneven density and color changes appear on the recorded image. To avoid such a problem, the rod lens array and the light emitting device array need to be accurately aligned relative to each other.

U.S. Pat. No. 7,486,306 ("the '306 patent") proposes a color image forming apparatus that can position the light spots of the component colors of the color of a light spot on the surface of a photosensitive drum so as to make the shapes of the light spots change to show the same shape in a main scanning direction as a technique for reducing the color change attributable to a change in the shape of the light spot.

The known technique in the '306 patent is provided to reduce the color change by making the shapes of the light spots of the component colors change to show the same shape and, hence, is accompanied by a problem as described below.

To make the light spots of the component colors show the same shape, the shapes of light spots of the component colors need to be adjusted so as to make them show the same and equal change.

For this purpose, the position of the light emitting device array and that of the rod lens array need to be accurately aligned relative to each other. Then, the optical writing head assembling process requires an adjustment unit or an adjustment step for accurate alignment. This makes the optical writing head costly.

SUMMARY OF THE INVENTION

In view of the above-identified problem, the present invention provides an optical writing head, as well as an image forming apparatus, having a simple configuration that can be assembled at low cost, unlike that of the prior art, without requiring any accurate alignment of the light emitting device array and the rod lens array thereof.

In one aspect, the present invention provides an optical writing head including a light emitting device array formed by arranging a plurality of light emitting devices in a main scanning direction, and an optical unit arranged between the light emitting device array and an image plane to form an image by rays of light emitted from the light emitting devices on the image plane, the light emitting devices operating as a light source portion for emitting parallel rays of light, the optical unit being formed by a two-dimensional grating.

In another aspect, the present invention provides an image forming apparatus including an optical writing head of the first aspect of the present invention, and a photosensitive section for forming a latent image thereon by irradiation of light from the optical writing head.

According to the present invention, an optical writing head having a simple configuration and an image forming apparatus including such an optical writing head can be realized at low cost, unlike the prior art, without requiring any accurate alignment of the light emitting device array and the rod lens array thereof.

Further features of the present invention will become apparent from the following description of exemplary embodiments, with reference to the attached drawings.

DESCRIPTION OF THE EMBODIMENTS

Now, an embodiment of the present invention will be described below by referring to FIG. 1.

Figure 1:
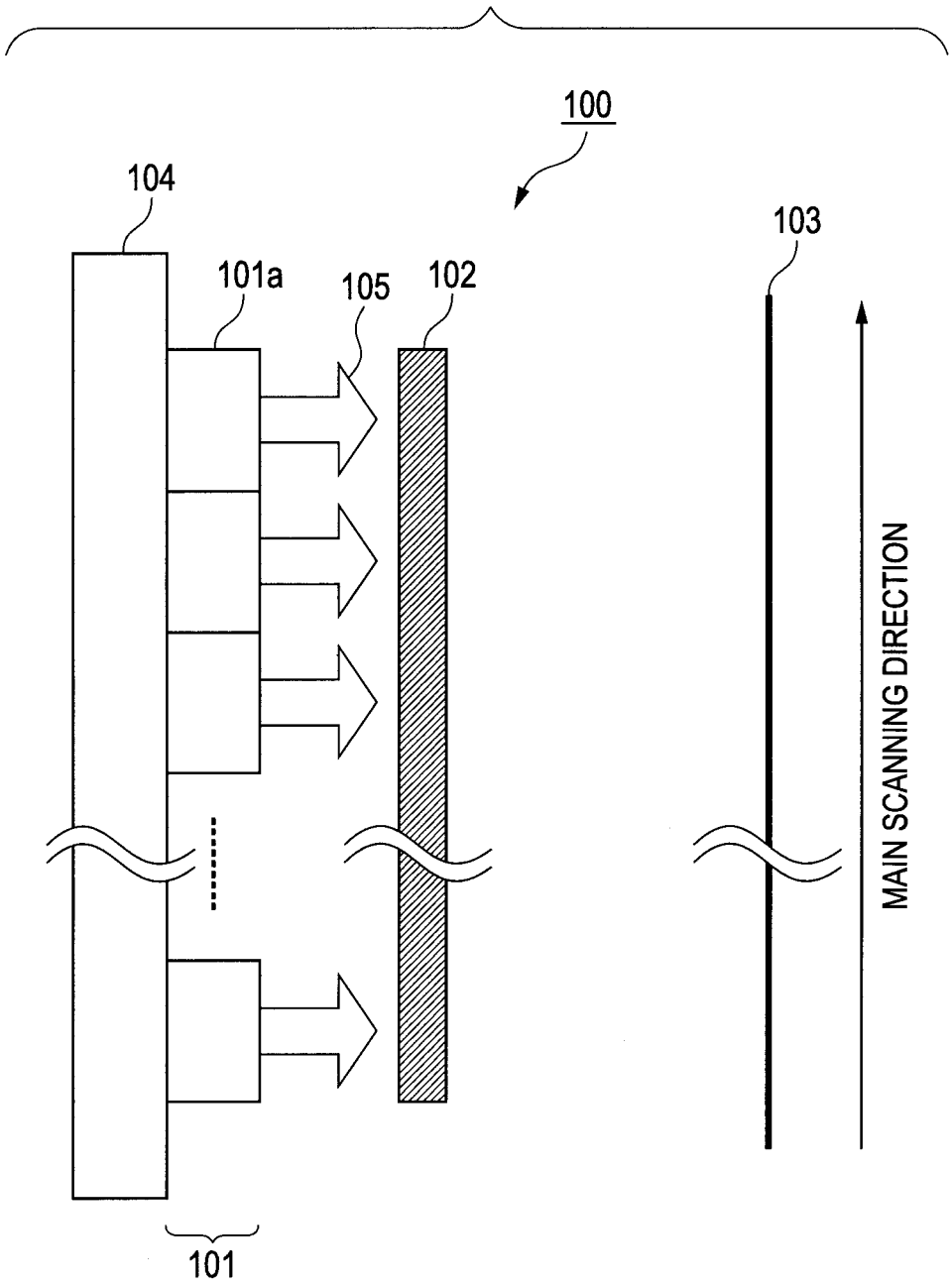
FIG. 1 is a schematic illustration of an optical writing head according to an embodiment of the present invention, illustrating the configuration thereof.

FIG. 1 is a schematic cross-sectional view of the optical writing head 100 taken along a plane running parallel to the main scanning direction.

FIG. 1 illustrates light emitting devices 101*a* arranged on a substrate 104.

The light emitting devices 101*a* are arranged to form a light source portion that emits parallel rays of light.

A light emitting device array 101 is formed by arranging a plurality of light emitting devices 101*a* in the main scanning direction.

FIG. 1 illustrates a grating 102 that is arranged between the light emitting device array 101 and image plane 103 to operate as an optical unit.

The optical writing head 100 is so configured as to form an image on the image plane 103 by rays of light 105 emitted in parallel with the optical axis from the light emitting devices 101*a* and by means of the grating 102.

The light emitting devices 101*a* may be semiconductor lasers, LEDs, organic ELs, or other known light emitting devices.

An image forming apparatus including an optical writing head 100 according to the present invention can be formed by forming the image plane 103 by means of a photosensitive drum (photosensitive section) that can form a latent image by irradiating rays of light.

Figure 2A:
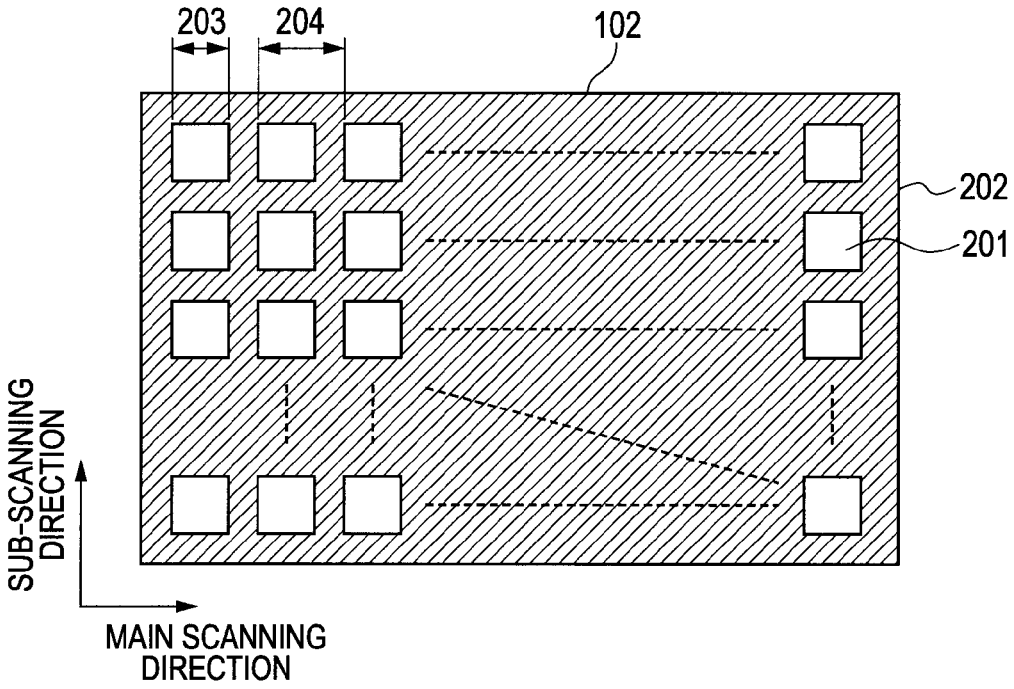
FIGS. 2A and 2B are schematic illustrations of the grating of the optical writing head according to the embodiment of the present invention.
Figure 2B:
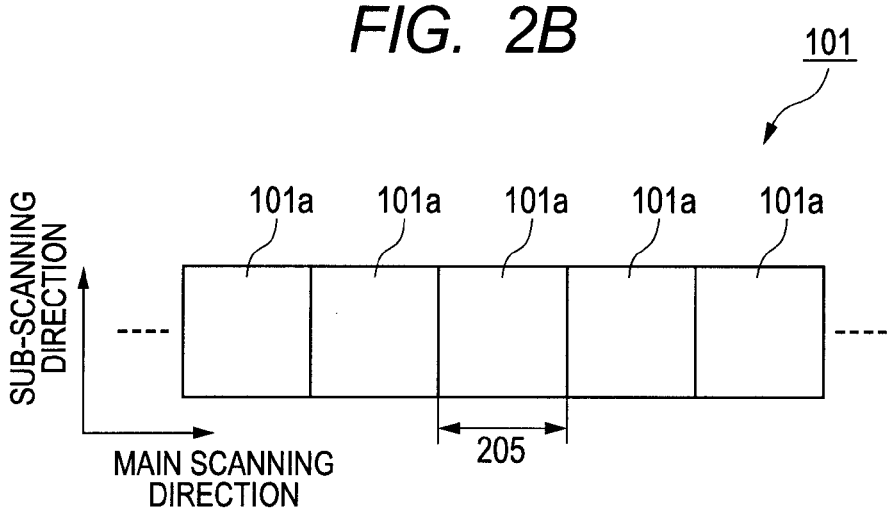

FIGS. 2A and 2B are schematic illustrations of the grating 102 of the optical writing head according to the embodiment of the present invention.

FIG. 2A. schematically illustrates the grating 102 on a plane running in parallel with the main scanning direction and also with the sub-scanning direction.

Referring to FIG. 2A, the grating 102 includes a background portion 202 and an aperture portion 201 where apertures are arranged periodically.

In the instance of FIG. 2A, the grating 102 has a two-dimensional structure as the aperture portion 201 shows periodicity in two directions, including the main scanning direction and the sub-scanning direction that is orthogonal relative to the main scanning direction. More specifically, the grating 102, having a two-dimensional periodic structure, can be formed by periodically arranging the apertures of the aperture portion 201 both in the main scanning direction and in the sub-scanning direction in the background portion that operates as a light-shielding portion.

The background portion 202 is formed to operate as a light-shielding portion by using a medium having a refractive index different from the aperture portion 201 or a medium having a characteristic of not allowing any light that reflects and absorbs rays of light from the light emitting devices 101*a* to transmit through it.

FIG. 2A denotes the width 203 of each of the apertures of the aperture portion 201 and the period 204 of the aperture arrays of the aperture portion 201.

FIG. 2B schematically illustrates the light emitting device array 101 as viewed in a direction orthogonal relative to the main scanning direction and also to the sub-scanning direction.

Referring to FIG. 2B, the light emitting device array 101 is formed by periodically arranging light emitting devices 101*a* in the main scanning direction with a period equal to the period of light source 205.

An image can be recorded on the photosensitive drum that is arranged to provide an image plane 103 by modulating the flux of light emitted from the light emitting device array 101 in response to an image signal.

Figure 3A:
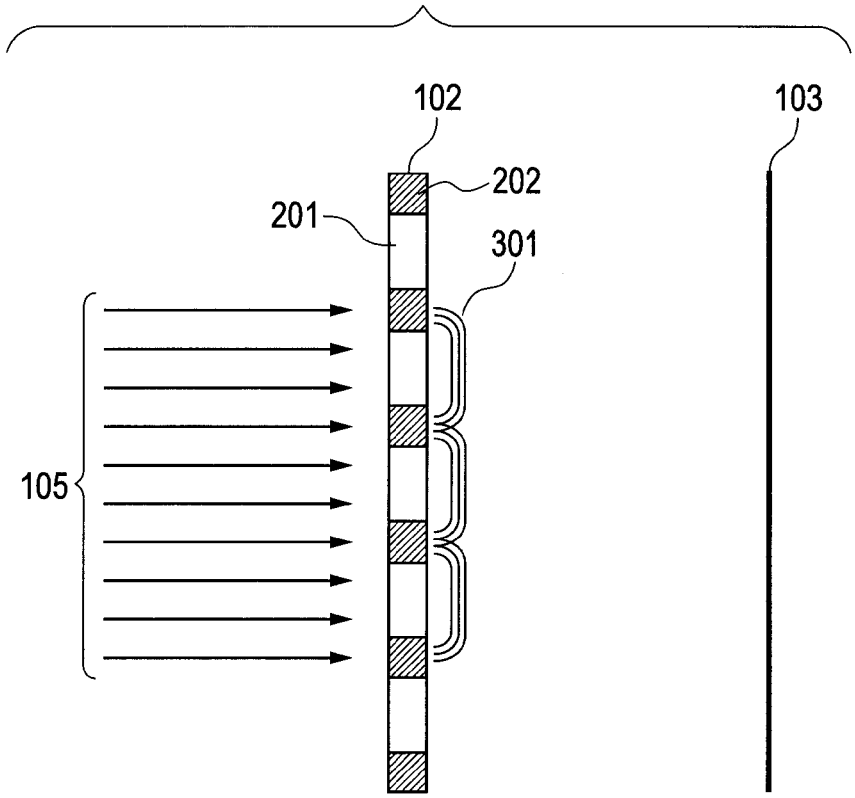
FIGS. 3A and 3B are schematic illustrations of the principle of the optical writing head according to the embodiment of the present invention.

FIG. 3A schematically illustrates how rays of light 105 emitted from light emitting devices 101*a* are diffracted by the grating 102.

As rays of light 105 enter the grating 102, they are diffracted at the aperture portion 201 and the background portion 202 to produce diffracted rays of light 301. A diffracted image is formed on the image plane 103 as the diffracted rays of light 301 are propagated.

Figure 3B:
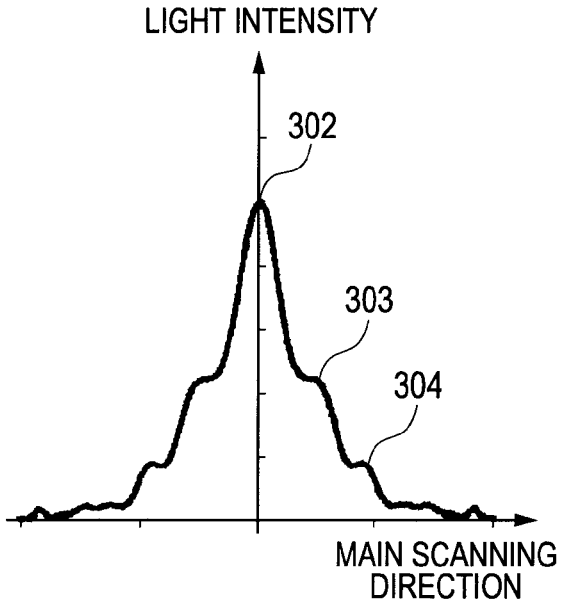

A light intensity distribution as shown in FIG. 3B can be obtained on the image plane 103 when only rays of light 105 within a limited scope are allowed to enter the grating 102.

FIG. 3B, the horizontal axis indicates the coordinate on the image plane 103 in the main scanning direction, whereas the vertical axis indicates the light intensity.

When only rays of light 105 within a limited scope are allowed to enter the grating 102, the intensities of diffracted light of higher orders are reduced and, hence, a spot-shaped light intensity distribution that is dominated by zero order diffracted light 302 can be obtained on the image plane 103.

Note that, in FIG. 3B, peaks 303 and 304, respectively, indicate the light intensity distribution of first order diffracted light and second order diffracted light.

Figure 4A:
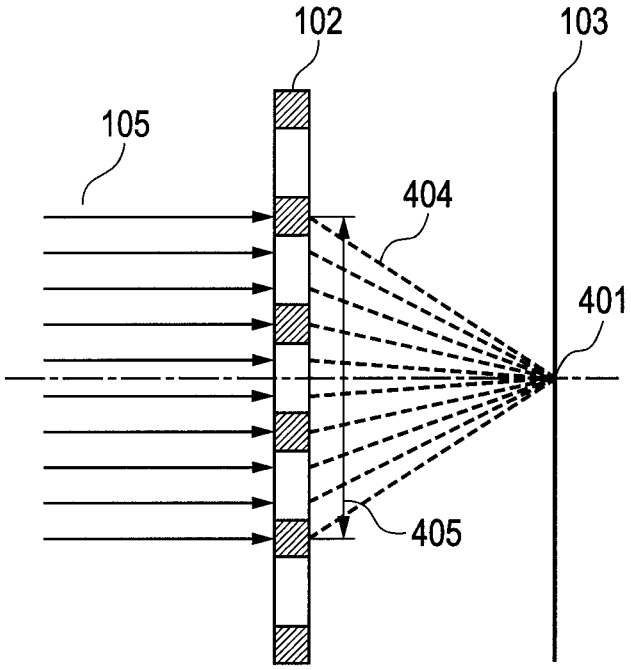
FIGS. 4A and 4B are schematic illustrations of the principle of the optical writing head according to the embodiment of the present invention.
Figure 4B:
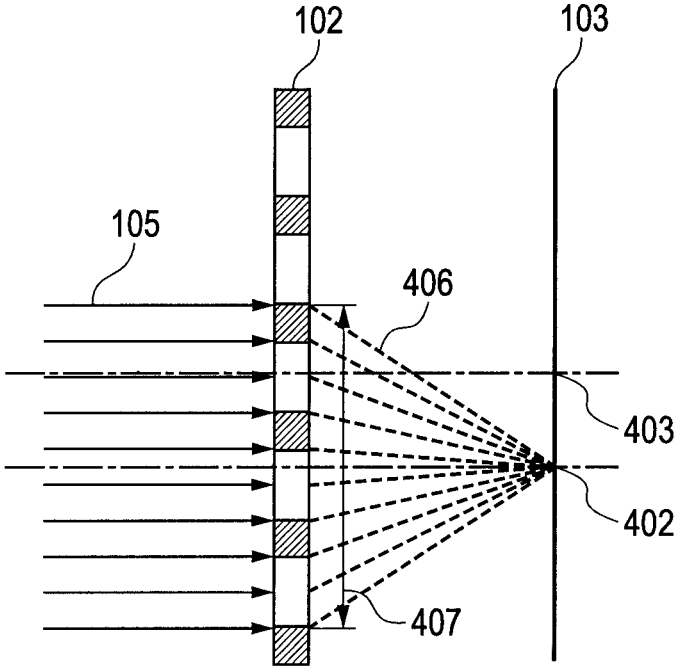

FIG. 4A schematically illustrates the light spot center position produced by the grating 102 when the center of the grating 102 and that of the light beam 105 emitted from the light emitting devices 101*a* agree with each other. FIG. 4B schematically illustrates the light spot center position produced by the grating 102 when the center 403 of the grating 102 and the center 402 of the light beam 105 emitted from the light emitting devices 101*a* are displaced from each other. In the case of FIG. 4A, transmitted and diffracted rays of light 404 that are produced as the light beam 105 is diffracted by the grating 102 are propagated from the scope 405 toward the image plane 103, and the transmitted and diffracted rays of light 404 are in phase with each other at position 401 that agrees with the center position of the scope 405, to form a light spot center. The center positions of the scope 405 and the light beam 105 agree with each other, and thus, the light spot center position on the image plane 103 agrees with the center position of the light beam 105. In the case of FIG. 4B, on the other hand, transmitted and diffracted rays of light 406 that are produced as the light beam 105 is diffracted by the grating 102 are propagated from the scope 407 toward the image plane 103, and the transmitted and diffracted rays of light 406 are in phase with each other at the center position 402 of the scope 407.

Differently stated, the light spot center position on the image plane 103 agrees with the center position 402 of the light beam 105 when the center position of the scope 407 agrees with the center position of the light beam 105.

If the background portion 202 of the grating 102 is formed by a light-shielding medium, the center position of the scope 407 and the center position of the light beam 105 do not necessarily agree with each other, but the quantity of the displacement is relatively small if compared with the period of the grating 102.

In other words, the coordinates of the center of the light spot formed on the image plane do not depend on the relative positional relation between the grating 102 and the light emitting devices 101*a*, but is determined by the center position of the light beam 105 emitted from the light emitting devices 101*a*.

Thus, the optical writing head of this embodiment having the above-described configuration does not requite any accurate alignment of the light emitting devices 101*a* and the grating 102 and, hence, can be realized with a simple configuration at low cost.

While rays of light that run in parallel with the optical axis are emitted from the light emitting device 101*a* in the above description of the present invention, rays of light that are emitted from the light emitting devices 101*a* are not necessarily required to run completely in parallel with the optical axis.

An image can be formed on the image plane 103 with a small light spot diameter when the flux of light emitted from the light emitting devices 101*a* has a projection angle of within ±1 degree.

EXAMPLES

Now, the present invention will be described further by way of examples.

Example 1

An optical writing head according to the present invention and having a configuration as described below by referring to FIGS. 5A to 5D was prepared in Example 1.

Figure 5A:
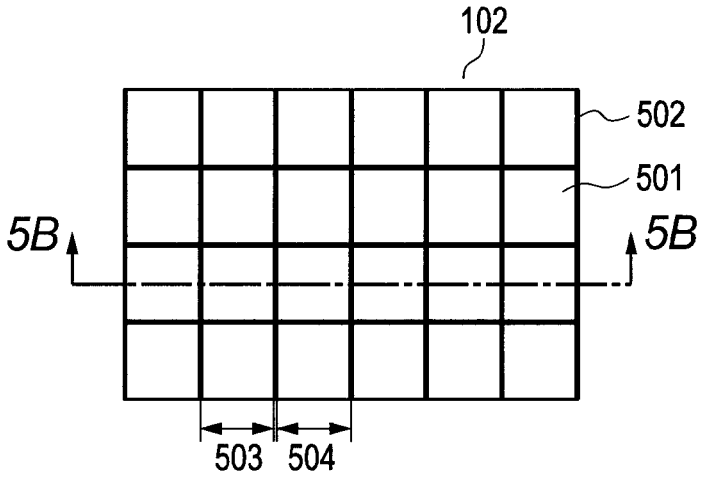
FIGS. 5A, 5B, 5C, and 5D are schematic illustrations of the optical writing head according to Example 1 of the present invention.
Figure 5B:
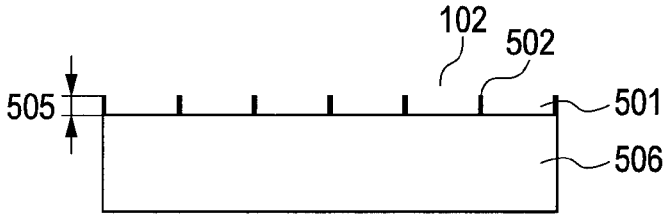

A grating 102 as shown in FIGS. 5A and 5B was used in the optical writing head 100 of this Example.

FIG. 5A is a top plan view of the grating 102 and FIG. 5B is a cross-sectional view taken along line 5B-5B in FIG. 5A.

The grating 102 is of a structure showing a periodic refractive index distribution produced by an aperture portion 501 and a background portion 502 on a substrate 506.

The background portion 502 and the aperture portion 501 are formed by respective transparent materials whose refractive indexes differ from each other. For example, the aperture portion 501 may be formed by air, while the peripheral portion 502 may be formed by a dielectric material such as quartz.

Of the grating 102 of this example, the aperture portion 501 is formed by air and the apertures thereof have a width 503 of 38 μm and are arranged with a period 504 of 40 μm.

The background portion 502 is formed by a transparent material showing a refractive index of 1.41 and has a thickness 505 of 150 nm. Parallel rays of light having a wavelength of 500 nm are irradiated from the light emitting devices 101*a* onto the grating 102 within a region having a radius of 50 μm.

Figure 5C:
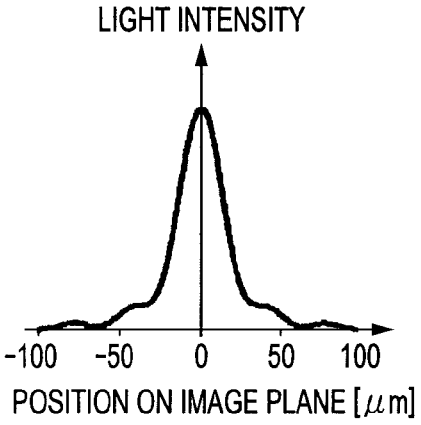

FIG. 5C shows the light intensity distribution produced by the optical writing head 100 having the above-described configuration on the image plane 103 when the distance between the grating 102 and the image plane 103 was made equal to 6 mm.

In FIG. 5C, the horizontal axis indicates the position on the image plane in the main scanning direction relative to the center of the light emitting devices 101*a*, and the vertical axis indicates the light intensity.

Figure 5D:
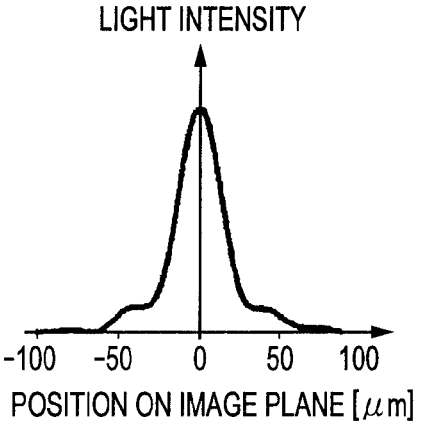

A spot-shaped image is formed by zero order light with a radius of 28 μm. Note that, according to the present invention, the radius of the image is led out with 1/exp(2) of the peak light intensity on the image plane. FIG. 5D shows the light intensity distribution on the image plane 103 when the position of the light emitting devices 101*a* and that of the grating 102 are relatively displaced by 10 μm from each other in the main scanning direction.

If the position of the light emitting devices 101*a* and that of the grating 102 are relatively displaced from each other, an image is formed with a radius 28 μm and the center position of the image agrees with that of the light emitting devices 101*a*.

Thus, if the position of the light emitting devices 101*a* and that of the grating 102 are relatively displaced from each other, an image is formed so as to make the center position of the image agree with that of the light emitting devices 101*a*.

A grating utilizing a phase difference is provided in this example by forming the background portion 502, using a transparent material showing a refractive index different from the aperture portion 501.

A phase difference type grating can raise the efficiency of utilization of light and the influence of first order light can be reduced by the phase difference.

Thus, a spot-shaped image having a small radius can be formed to realize high definition printing.

Since the grating 102 has a periodic structure, the center position of the spot is determined by the center position of the light emitting devices 101*a*, if the position of the light emitting devices 101*a* and that of the grating 102 are relatively displaced from each other by more than the period of the grating 102.

Therefore, the light emitting device array 101 and the grating 102 do not need to be aligned accurately.

While an aperture portion having square apertures is arranged in this example, the grating 102 is only required to diffract light that strikes the grating 102, and form a spot-shaped light intensity distribution by zero order light on a desired image plane.

In other words, the aperture portion may alternatively have polygonal apertures, such as rectangular or triangular apertures. Still, alternatively, the aperture portion may have circular or elliptical apertures. However, the aperture portion may preferably have square or circular apertures, because such an aperture portion can be prepared with ease. While the apertures of the aperture portion are arranged respectively at lattice points in this example, a similar effect can be achieved if a triangular grating is employed.

While the background portion 502 is made to show a refractive index greater than the aperture portion 501 in this example, the aperture portion 501 and the background portion 502 are only requited to show a phase difference and, hence, a similar reflect can be achieved if the refractive index of the aperture portion 501 is greater than that of the background portion 502.

Rays of light 105 are made to irradiate a region having a radius of 50 μm in this example. Then, for this purpose, light emitting devices 101*a* need to be arranged with a period of at least 100 μm. When images are to be formed with a period of not more than 100 μm by means of the optical writing head 100 of this example, a plurality of columns of light emitting devices 101*a* also need to be arranged in the sub-scanning direction, unlike the instance illustrated in FIG. 2B.

An image can be recorded with a desired level of resolution by modulating the light emitting devices 101*a* of each of the columns in synchronism with the rotary motion of the photosensitive drum that is arranged to provide an image plane 103.

While the ratio or the width 503 to the period 504 of the aperture portion 501 was made to be equal to 0.95 in this example, the ratio may be greater or lesser than this value. If diffracted light due to Fraunhofer diffraction from the aperture portion 501 is taken into consideration, the intensity of first order diffracted light can be given by the formula shown below:

$$\left(\sin\left(2\pi\frac{w/2}{p}\right)\Big/2\pi\frac{w/2}{p}\right)^2$$

where w is the width 503 of the apertures or the aperture portion 501 and p is the period 504.

To reduce the spot diameter, the intensity of first order diffracted light is preferably less than 1/exp(2). In other words:

$$w/p>0.7.$$

Thus, the ratio of the width 503 to the period 504 is desirably greater than 0.7.

Example 2

An optical writing head using a grating 102 that is different from the grating of Example 1, and can be prepared more easily, will be described below by referring to FIGS. 6A to 6D.

The optical writing head 100 of this example has the same configuration us that of the one shown in FIG. 1, and the grating 102 thereof is formed by arranging square apertures, respectively, at the lattice points of a square grating.

Figure 6A:
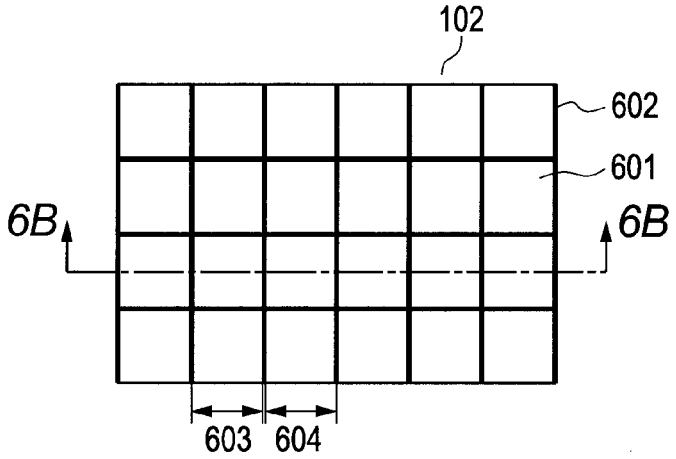
FIGS. 6A, 6B, 6C, and 6D are schematic illustrations of the optical writing head according to Example 2 of the present invention.

FIG. 6A is a top view of the grating 102 that includes a background portion 602 and an aperture portion 601.

Figure 6B:
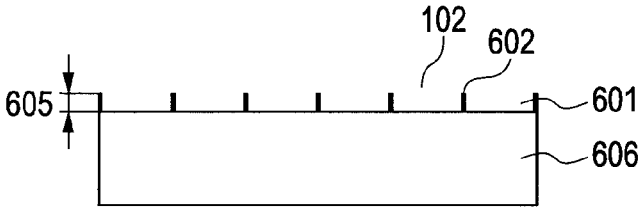

FIG. 6B is a cross-sectional view of the grating 102 taken along line 6B-6B in FIG. 6A. As shown in FIG. 6B, the grating 102 is arranged on a transparent substrate 606.

The background portion 602 is required only to have a characteristic of reflecting and/or absorbing light emitted from light emitting device array 101 so as not to transmit light. The background portion 602 may typically be formed by means of metal, such as silver.

The transparent substrate 606 is required only to be transparent relative to light emitted from the light emitting device array 101, and may typically be formed by means of quartz.

The grating 102 of this example has a structure including an aperture portion having apertures with a width 603 of 36 μm that are arranged with a period 604 of 40 μm. The grating 102 has a thickness 605 of 100 nm.

Parallel rays of light having a wavelength of 500 nm are emitted from the light emitting devices 101*a* and irradiated onto a region of 50×50 μm on the grating 102.

Figure 6C:
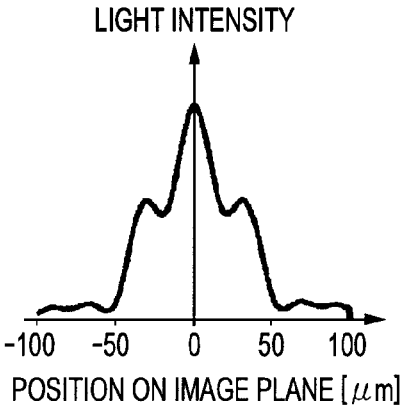

FIG. 6C shows the light intensity distribution produced by the optical writing head 100 having the above-described configuration on the image plane 103 when the distance between the grating 102 and the image plane 103 was made equal to 5.5 mm.

In FIG. 6C, the horizontal axis indicates the position on the image plane in the main scanning direction relative to the center of the light emitting devices 101*a*, and the vertical axis indicates the light intensity.

An image of a radius of 46 μm is formed by zero order diffracted light and first order diffracted light.

Figure 6D:
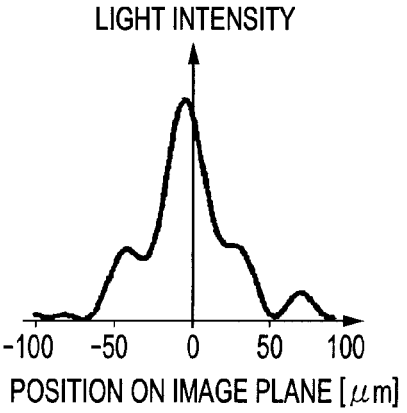

FIG. 6D shows the light intensity distribution on the image plane 103 when the position of the light emitting devices 101*a* and that of the grating 102 are relatively displaced by 10 μm from each other in the main scanning direction.

In FIG. 6D, the horizontal axis indicates the position on the image plane in the main scanning direction relative to the center of the light emitting devices 101*a* and the vertical axis indicates the light intensity.

An image having a radius of 48 μm is formed at a position displaced by 4 μm from the center of the light emitting devices 101*a*.

Since the background portion 602 of the grating 102 of this example is formed by a light-shielding medium, the asymmetry of the light intensity distribution is boosted, and the image was formed at a position displaced by 4 μm from the center position of the light emitting devices 101*a*.

If, however, the position of the grating 102 and that of the light emitting devices 101*a* are displaced to a large extent relative to each other, the center position of the image formed on the image plane 103 would not be displaced by more than the period of the grating 102, because of the periodic structure of the grating 102.

Additionally, the displacement, if any, of the center position of the image due to the light emitting devices 101*a* is always equal to a constant value when the period of the light source 205 (FIG. 2B), that is, the period of the plurality of light emitting devices arranged in the main scanning direction of the light emitting device array 101, is made equal to integer times of the period of the grating 102.

Then, as a result, the period of the formed images becomes equal to the period of the light emitting device array 101.

Thus, the optical writing head 100 of this example does not require any accurate alignment of the light emitting device array 101 and the grating 102.

The background portion 602 of the grating 102 of this example is formed as a light-shielding portion that is made of a light-shielding medium.

A metal material that can be worked with ease, or an organic material that can produce a uniform film, can be used as light-shielding medium. Hence, the grating 102 can be prepared more easily than the grating 102 of Example 1.

While an aperture portion having square apertures is arranged in this example, the grating 102 is only required to diffract light that strikes the grating 102, and form a spot-shaped light intensity distribution by zero order light on a desired image plane.

In other words, the aperture portion may alternatively have polygonal apertures, such as rectangular or triangular apertures. Still alternatively, the aperture portion may have circular or elliptical apertures. However, the aperture portion may preferably have square or circular apertures, because such an aperture portion can be prepared with ease. While the apertures of the aperture portion are arranged respectively at lattice points of a square grating, in this example, to similar effect can be achieved if a triangular grating is employed.

While the ratio of the width 603 to the period 604 of the aperture portion 601 is made to be equal to 0.90, in this example, the ratio may be greater or smaller than this value.

The displacement of the center position of the spot formed on the image plane 103 from the center position of the light emitting devices 101*a* can be reduced by making the ratio of the width 603 to the period 604 of the aperture portion 601 desirably greater than 0.7.

Figure 7A:
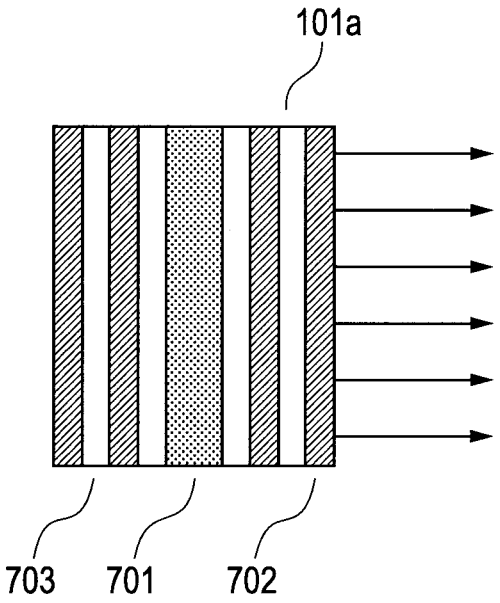
FIGS. 7A and 7B are schematic illustrations of light emitting devices applicable to the present invention.
Figure 7B:
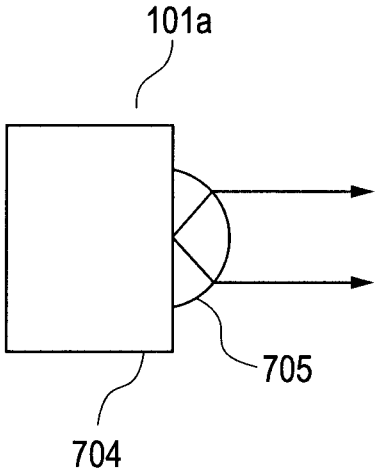

FIGS. 7A and 7B are schematic illustrations of light emitting devices 101*a* applicable to the present invention.

FIG. 7A shows a surface emission semiconductor laser formed by sandwiching an active layer 701 between DBR reflector sections 702 and 703.

Parallel rays of light are emitted from the light emitting device 101*a* in this configuration.

FIG. 7B shows a light emitting device 101*a* in which at light emitting portion 704 of an LED or an organic EL device and an optical device 705 are integrally formed.

Divergent rays of light from the light emitting portion 704 are converted into parallel rays of light by the optical device 705 formed by a lens.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An optical writing head comprising:

a light emitting device array having a plurality of light emitting devices; and an optical unit arranged between the light emitting device array and an image plane, to form an image by light emitted from the light emitting devices on the image plane, wherein the optical unit includes a two-dimensional diffractive grating, wherein the two-dimensional diffractive grating is configured to diffract zero-order diffracted light and first-order diffracted light, wherein the two-dimensional diffractive grating is configured so that the light intensity distribution of the first-order diffracted light diffracted by the two-dimensional diffractive grating overlaps the light intensity distribution of the zero-order diffracted light diffracted by the two-dimensional diffractive grating at the image plane wherein the two-dimensional diffractive grating includes a first portion and second portions arranged periodically in the first portion, wherein the second portions are arranged with a first period in a first direction, and wherein the plurality of light emitting devices are arranged in the first direction with a second period that is an integer times that of the first period.

2. The optical writing head according to claim 1, wherein the second portions are arranged periodically in the first direction and in a second direction that is different from the first direction.

3. The optical writing head according to claim 2, wherein the light emitting devices are arranged both in the first direction and in the second direction.

4. The optical writing head according to claim 1, wherein each of the second portions has a width in the first direction and is arranged with the first period in the first direction, the ratio of the width to the first period being greater than 0.7.

5. An image forming apparatus comprising:

an optical writing head according to claim 1; and a photosensitive section for forming a latent image by means of light irradiated from the optical writing head.

6. The optical writing head according to claim 1, wherein each of the light emitting devices emits parallel rays of light.

7. The optical writing head according to claim 1, wherein the light emitting devices are ones of semiconductor lasers, LEDs, and organic ELs.

8. The optical writing head according to claim 1, wherein the first portion and each of the second portions include respectively transparent materials whose refractive indexes differ from each other.

9. The optical writing head according to claim 1, wherein the two-dimensional diffractive grating is configured so that the image formed by light emitted from the light emitting devices can be formed on the image plane by the two-dimensional diffractive grating alone.

10. An optical writing head comprising:

a light emitting device array having a plurality of light emitting devices; and an optical unit arranged between the light emitting device array and an image plane, to form an image by light emitted from the light emitting devices on the image plane, wherein the optical unit includes a two-dimensional diffractive grating, wherein the two-dimensional diffractive grating includes a first portion, wherein second portions are arranged periodically, in the first portion, in a first direction and in a second direction that is different from the first direction, wherein each of the second portions has a width in the first direction and is arranged with a first period in the first direction, the ratio of the width to the first period being greater than 0.7, and wherein the plurality of light emitting devices are arranged in the first direction with a second period that is an integer times that of the first period.

11. The optical writing head according to claim 10, wherein the first portion includes a light-shielding medium.

12. The optical writing head according to claim 10, wherein each of the second portions is an aperture.

13. The optical writing head according to claim 10, wherein each of the light emitting devices emits parallel rays of light.

14. The optical writing head according to claim 10, wherein the light emitting devices are ones of semiconductor lasers, LEDs, and organic ELs.

15. An image forming apparatus comprising:

an optical writing head according to claim 10; and a photosensitive section for forming a latent image by means of light irradiated from the optical writing head.

16. The optical writing head according to claim 10, wherein the two-dimensional diffractive grating is configured so that the image formed by light emitted from the light emitting devices can be formed on the image plane by the two-dimensional diffractive grating alone.

17. An optical writing head comprising:

a light emitting device array having a plurality of light emitting devices; and an optical unit arranged between the light emitting device array and an image plane, to form an image by light emitted from the light emitting devices on the image plane, wherein the optical unit includes a two-dimensional diffractive grating, wherein the two-dimensional diffractive grating includes a first portion and second portions arranged periodically in the first portion, wherein the second portions are arranged with a first period in a first direction, and wherein the plurality of light emitting devices are arranged in the first direction with a second period that is an integer times that of the first period.

18. The optical writing head according to claim 17, wherein the second portions are arranged periodically in the first direction and in a second direction that is different from the first direction.

19. The optical writing head according to claim 17, wherein the light emitting devices are arranged both in the first direction and in the second direction.

20. The optical writing head according to claim 17, wherein the two-dimensional diffractive grating is configured so that the image formed by light emitted from the light emitting devices can be formed on the image plane by the two-dimensional diffractive grating alone.

21. The optical writing head according to claim 17, wherein the first portion includes a light-shielding medium.

22. The optical writing head according to claim 17, wherein each of the second portions is an aperture.

23. The optical writing head according to claim 17, wherein the first portion and each of the second portions include respectively transparent materials whose refractive indexes differ from each other.

24. An image forming apparatus comprising:

an optical writing head according to claim 17; and a photosensitive section for forming a latent image by means of light irradiated from the optical writing head.

* * * * *